US008511869B1

(12) United States Patent
Fountain

(10) Patent No.: US 8,511,869 B1
(45) Date of Patent: Aug. 20, 2013

(54) DECORATIVE WINDOW CANDLE TOP

(76) Inventor: Roger Fountain, Sykesville, MD (US)

( * ) Notice: Subject to any disclaimer, the term of this patent is extended or adjusted under 35 U.S.C. 154(b) by 0 days.

(21) Appl. No.: 13/356,683

(22) Filed: Jan. 24, 2012

(51) Int. Cl.
*F21V 35/00* (2006.01)

(52) U.S. Cl.
USPC ..... 362/392; 362/447; 362/806; 362/810

(58) Field of Classification Search
USPC ..... 362/253, 351, 392, 396, 447, 806, 362/810
See application file for complete search history.

(56) References Cited

U.S. PATENT DOCUMENTS 5,165,790 A * 11/1992 Boschetto ..... 362/396
5,274,537 A 12/1993 Altman
5,526,243 A 6/1996 Masters
6,000,820 A 12/1999 Murray
D544,790 S 6/2007 Bouveret et al.
2006/0176703 A1 8/2006 Cayton et al.
2009/0302184 A1 * 12/2009 Boschetto ..... 248/311.2
2010/0214541 A1 8/2010 Chien

* cited by examiner

*Primary Examiner* — Stephen F Husar
*Assistant Examiner* — Meghan Dunwiddie

(57) ABSTRACT

The decorative window candle top includes a bracket and a plurality of interchangeable decorations that when attached places the interchangeable decoration in front of and adjacent to the electric light bulb of a window candle light. The interchangeable decorations personalize the appearance of the window candle light, and come in a variety of styles. The bracket is positioned between the candlestick and the light bulb and includes a pair of mounting pins. The mounting pins are used to enable attachment of one of the interchangeable decorations.

5 Claims, 3 Drawing Sheets

DECORATIVE WINDOW CANDLE TOP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of window candle lights, more specifically, a decorative top for use with said window candle lights.

Window candle lights have been around for quite some time, and provide a decorative appearance to a window from outside of said home or dwelling. The window candle lights are electric and include an incandescent bulb that resembles a flame from a candle when viewed from afar, such as outside of said window of said home or dwelling. The window candlelight offers nothing more than a decorative effect on its own. That being said, it may be desirable to customize the appearance of the window candlelight in order to personalize the decorative effect to a particular taste of an end user.

There is a need for an interchangeable decorative window order to provide an illuminative and decorative effect to the respective window. The device of the present application seeks to address the needs for additional decorative curiosity by introducing an apparatus having interchangeable decorative tops that produce different lighting effects and/or different seasonal decorative effects.

B. Discussion of the Prior Art

As will be discussed immediately below, no prior art discloses a decorative window candle top that includes a set of decorative tops that are interchangeable with respect to a bracket that is easily installed between the light bulb and the candle; wherein the bracket includes a pair of mounting pins that enable the decorative top to attach or detach there from as needed for different decorative and/or seasonal lighting effects; wherein the decorative top is positioned in front of the light bulb and is illuminated thereof.

The Murray Patent (U.S. Pat. No. 6,000,820) discloses a seasonal decoration for placement on top of an illuminated electric device, such as a candle. However, the seasonal decoration is not a decorative top that uses a bracket with interchangeable decorations for use with window candle lights.

The Chien Patent Application Publication (U.S. Pub. No. 2010/0214541) discloses a decorative ornamental and interchangeable light apparatus that can be changed with the seasons. However, the interchangeable light apparatus does not include a bracket that easily installs between a candle and the light bulb so as to provide a means for attachment of different decorative candle tops.

The Masters Patent (U.S. Pat. No. 5,526,243) discloses a decorative interchangeable electric candle or lighting device enclosure. However, the decoration encloses over the light source and is not a decorative candle top that is positioned in front of the light bulb.

The Cayton et al. Patent Application Publication (U.S. Pub. No. 2006/0176703) discloses a decorative electronic candle with a seasonal ornamental topper. Again, the decorative electronic candle does not include an interchangeable decoration that is positioned in front of a light bulb for use with a window candle light.

The Altman Patent (U.S. Pat. No. 5,274,537) discloses a decorative light arrangement in which the tops of the light can be changed to a seasonal decoration. However, the decorative light arrangement is not a window candle light in which an interchangeable decoration attaches and is displayed in front of the light bulb.

While the above-described devices fulfill their respective and particular objects and requirements, they do not describe a decorative window candle top that includes a set of decorative tops that are interchangeable with respect to a bracket that is easily installed between the light bulb and the candle; wherein the bracket includes a pair of mounting pins that enable the decorative top to attach or detach there from as needed for different decorative and/or seasonal lighting effects; wherein the decorative top is positioned in front of the light bulb and is illuminated thereof. In this regard, the decorative window candle top departs from the conventional concepts and designs of the prior art.

SUMMARY OF THE INVENTION

The decorative window candle top includes a bracket and a plurality of interchangeable decorations that when attached places the interchangeable decoration in front of and adjacent to the electric light bulb of a window candle light. The interchangeable decorations personalize the appearance of the window candle light, and come in a variety of styles. The bracket is positioned between the candlestick and the light bulb and includes a pair of mounting pins. The mounting pins are used to enable attachment of one of the interchangeable decorations.

It is an object of the invention to provide a decorative window candle top that is easily customized and which works with a window candle light.

A further object of the invention is to provide a decorative window candle top that consists of a bracket and a plurality of interchangeable decorations that attach individually to customize the outward appearance of the window candle light.

A further object of the invention is to provide a bracket that is installed between the light bulb and the candle stick and which includes mounting pins for attachment of the interchangeable decorations.

These together with additional objects, features and advantages of the decorative window candle top will be readily apparent to those of ordinary skill in the art upon reading the following detailed description of presently preferred, but nonetheless illustrative, embodiments of the decorative window candle top when taken in conjunction with the accompanying drawings.

In this respect, before explaining the current embodiments of the decorative window candle top in detail, it is to be understood that the decorative window candle top is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the decorative window candle top.

It is therefore important that the claims be regarded as including such equivalent construction insofar as they do not depart from the spirit and scope of the decorative window candle top. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
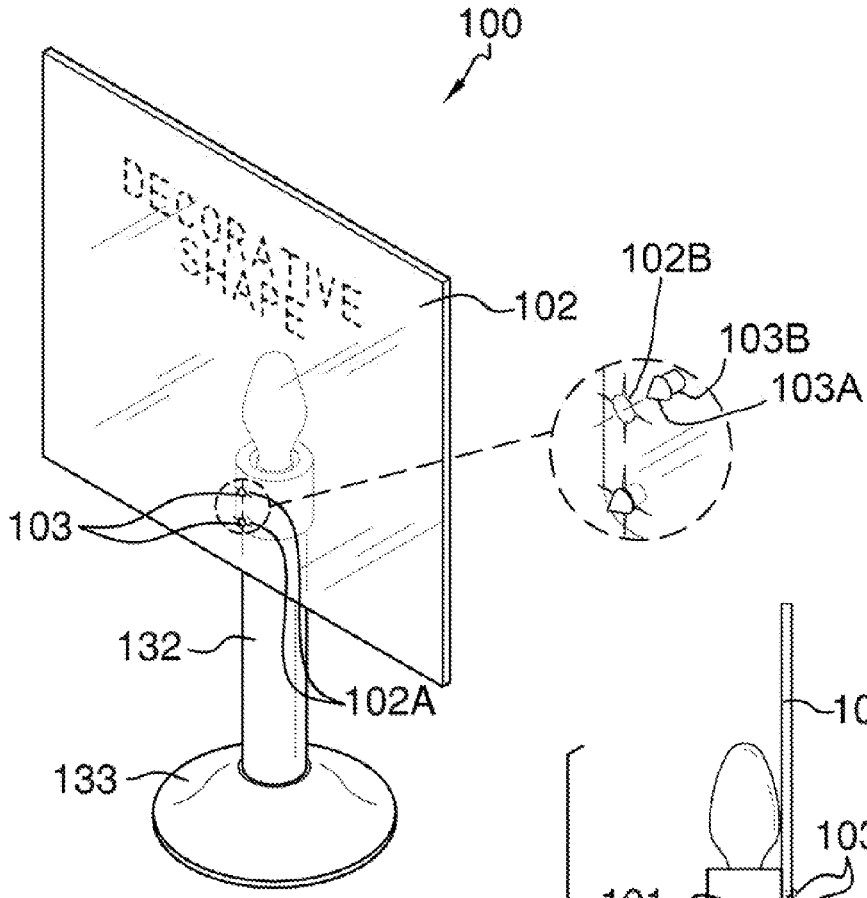
FIG. 1 illustrates a perspective view of the decorative window candle top installed on a window candle light in which the interchangeable decoration is of a generic ilk and indicates so by the words "decorative shape" provided thereon.
Figure 2:
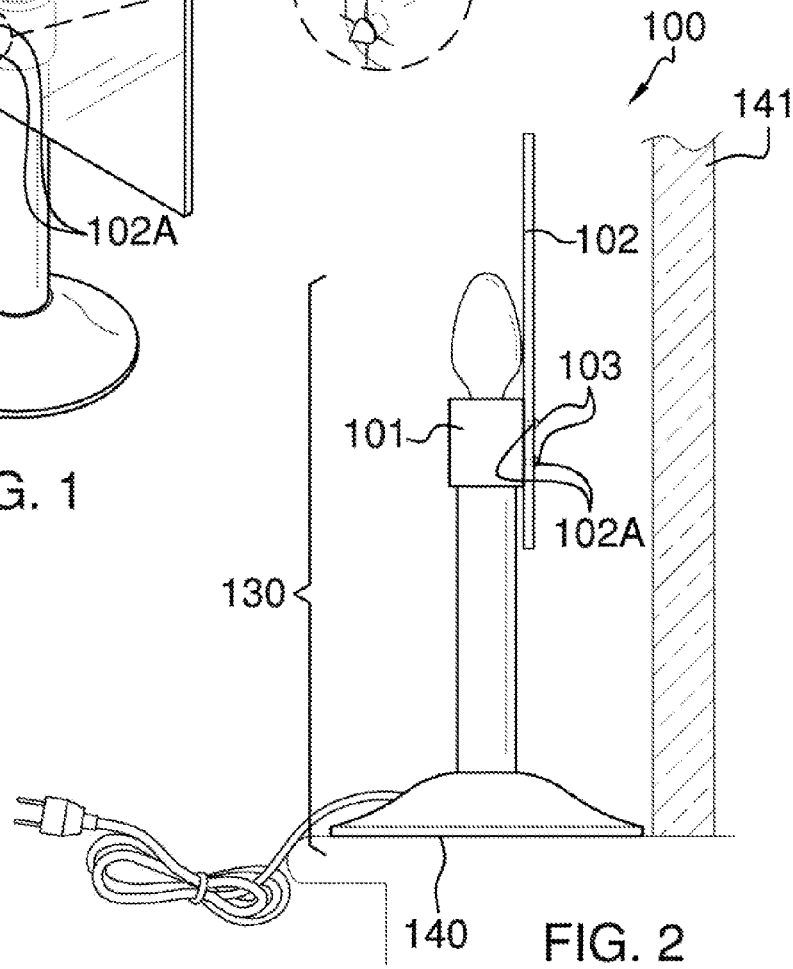
FIG. 2 illustrates a side view of the decorative window candle top installed on an existing window candle light, and detailing the location of the interchangeable decoration in front of the light bulb.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A decorative window candle top 100 (hereinafter invention) includes a bracket 101 and a plurality of interchangeable decorations 102.

As a preliminary matter it should be noted that a window candle light 130 is constructed of a light bulb 131 that screws into a candlestick 132, which extends upwardly from a base 133. Usually, the base 133 is seated onto a window sill 140 such that the candlestick 132 and the light bulb 131 are both visible from outside of a window 141.

The invention 100 is designed for use with the window candle light 130, and provides for customization of the window candle light 130 when in use, and from outside of a window.

The bracket 101 is a cylindrically-shaped object that has a shoulder 101A, which enables the bracket 101 to slide onto a top edge 132A of the candlestick 132. The shape of the bracket 101 enables the light bulb 131 to be subsequently screwed onto the candlestick 132 thereby securing the bracket 101 to the window candle light 130.

The bracket 101 also includes a pair of mounting pins 103 that protrude from the exterior surface of the bracket 101. The mounting pins 103 enable attachment of the various interchangeable decorations 102 onto the bracket 101. Moreover, the mounting pins 103 enable the respective interchangeable decoration 102 to be positioned in front of the light bulb 131 so as to enable illumination of the interchangeable decoration 102 in view of the window 141 thereby customizing the appearance of the respective window 141.

Figure 3:
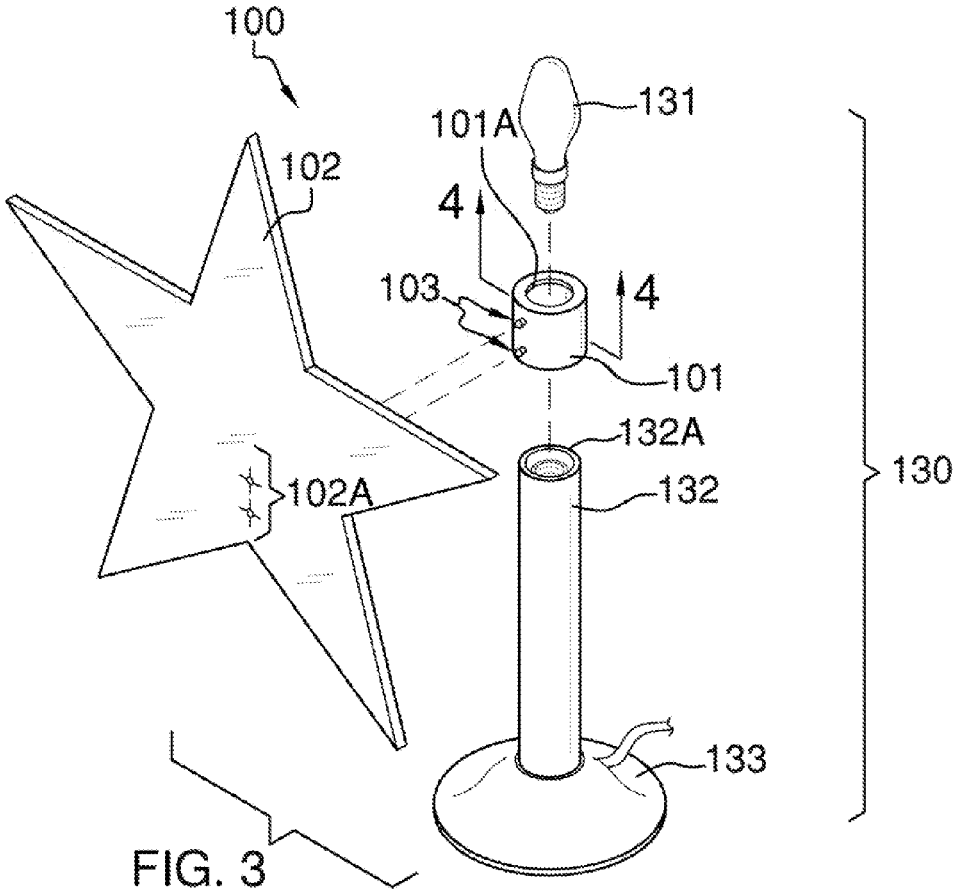
FIG. 3 illustrates an exploded view of the decorative window candle top composed of the bracket and an interchangeable decoration in which the bracket is positioned between the light bulb and the candle light.
Figure 4:
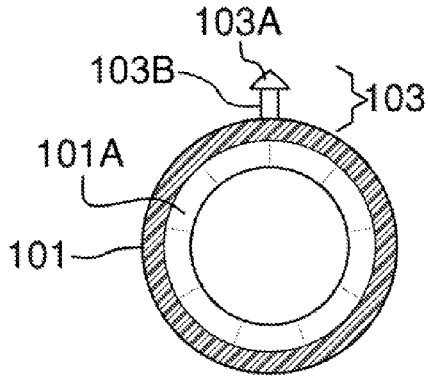
FIG. 4 illustrates a cross-sectional view of the decorative window candle top along line 4-4 in FIG. 3 and detailing the shape of the bracket.
Figure 5:
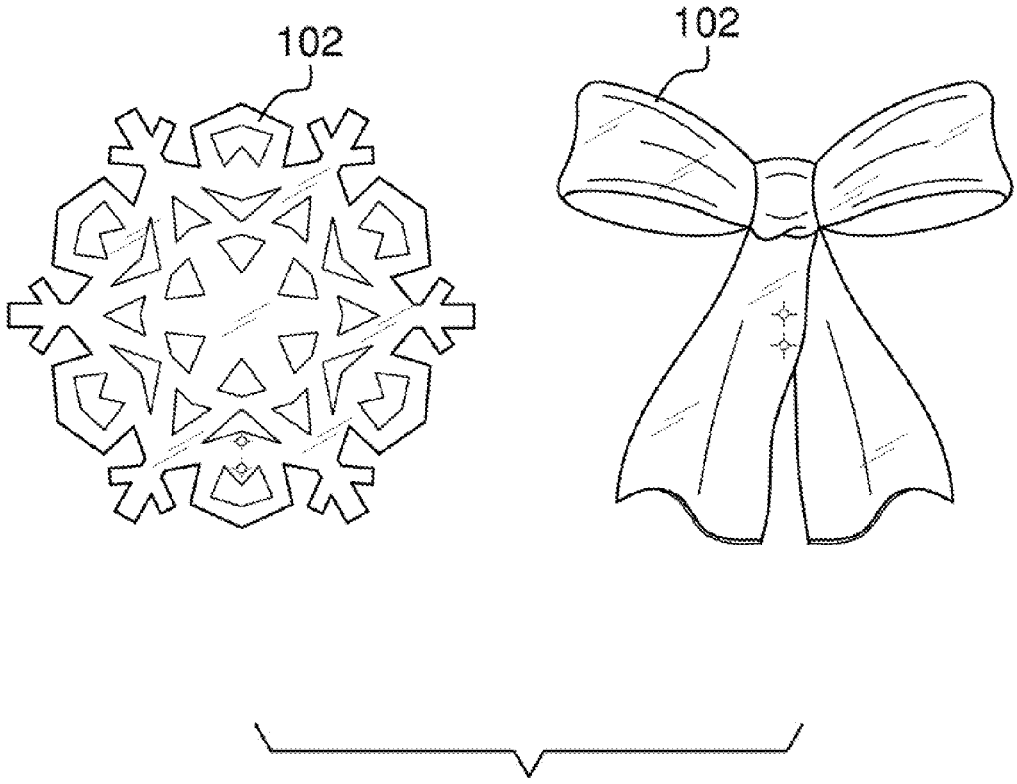
FIG. 5 illustrates a couple of different interchangeable decorations.

It shall be noted that the interchangeable decorations 102 may vary in size, color, shape, and decorative theme. More specifically, the interchangeable decorations 102 may be comprised of translucent or opaque materials that may enable light to shine there through giving the appearance of self-illumination from afar of said window 141. Referring to FIGS. 3 and 5, the interchangeable decoration 102 may resemble a star, a snowflake, a bow and ribbon. However, it is being asserted that the interchangeable decorations 102 may encompass other styles and themes involving holiday-oriented indicia comprising St. Patrick's Day, $4^{th}$ of July, Easter, etc.

The mounting pins 103 each include a mushroom head shaped member 103A that is constructed of a solid material. The interchangeable decorations 102 each include a pair of mounting holes 102A that coincide with the mounting pins 103 to enable fastening of the interchangeable decoration 102 to the bracket 101. It shall be noted that the mounting pins 103 form a linear array that is vertically oriented with respect to the interchangeable decoration 102. Additionally, the mounting holes 102A each resemble a hole with an "x" shaped slot opening thereon, which forms flexible armatures 102B. The mushroom head shaped member 103A passes across the hole 102A upon flex of the armatures 102B of the "x" shaped slot opening of each mounting hole 102A in order to secure the interchangeable decoration 102 in place on the bracket 101. Moreover, the mounting holes 102A include the hole to fit a shank 1038 of the pin 103 (see FIG. 4).

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A decorative window candle top comprising:

a plurality of interchangeable decorations that individually attach to a bracket;

wherein the bracket installs on an existing window candle light such that a respective interchangeable decoration is positioned between an existing light bulb of said existing window candle light;

wherein the bracket includes a pair of mounting brackets that extend outwardly from an exterior surface of said bracket;

wherein the mounting pins each include a mushroom head-shaped member of flexible construction;

wherein the mounting pins are aligned vertically to form a linear array;

wherein the interchangeable decorations each include mounting holes that correspond to the mounting pins of the bracket to enable attachment thereon; wherein the mounting holes each resemble a hole with an "x" shaped slot opening thereon, which forms flexible armatures whereby the mushroom head shaped member passes across the hole upon flex of the armatures of the "x" shaped slot opening of each mounting hole; wherein the mounting holes include said hole to fit a shank of the pin therein.

2. The decorative window candle top as described in claim 1 wherein the interchangeable decorations customize the window candle light irrespective of use with a window.

3. The decorative window candle top as described in claim 1 wherein the bracket is of cylindrically-shaped construction and includes a shoulder such that the bracket is installed between an existing candlestick of said existing window candle light and said existing light bulb.

4. A decorative window candle top comprising:

a plurality of interchangeable decorations that individually attach to a bracket;

wherein the bracket installs on an existing window candle light such that a respective interchangeable decoration is positioned between an existing light bulb of said existing window candle light;

wherein the bracket is of cylindrically-shaped construction and includes a shoulder such that the bracket is installed between an existing candlestick of said existing window candle light and said existing light bulb;

wherein the bracket includes a pair of mounting brackets that extend outwardly from an exterior surface of said bracket;

wherein the mounting pins each include a mushroom head-shaped member of flexible construction;

wherein the mounting pins are aligned vertically to form a linear array;

wherein the interchangeable decorations each include mounting holes that correspond to the mounting pins of the bracket to enable attachment thereon; wherein the mounting holes each resemble a hole with an "x" shaped slot opening thereon, which forms flexible armatures whereby the mushroom head shaped member passes across the hole upon flex of the armatures of the "x" shaped slot opening of each mounting hole; wherein the mounting holes include said hole to fit a shank of the pin therein.

5. The decorative window candle top as described in claim 4 wherein the interchangeable decorations customize the window candle light irrespective of use with a window.

* * * * *